US009560725B2

(12) United States Patent
Wilson

(10) Patent No.: US 9,560,725 B2
(45) Date of Patent: Jan. 31, 2017

(54) ILLUMINATED SPORTS SYSTEM

(71) Applicant: AfterDark Technologies, Woburn, MA (US)

(72) Inventor: Daniel John Wilson, Chelsea, MA (US)

(73) Assignee: AfterDark Technologies, Woburn, MA (US)

( * ) Notice: Subject to any disclaimer, the term of this patent is extended or adjusted under 35 U.S.C. 154(b) by 0 days.

(21) Appl. No.: 14/470,123

(22) Filed: Aug. 27, 2014

(65) Prior Publication Data

US 2015/0062959 A1 Mar. 5, 2015

Related U.S. Application Data

(60) Provisional application No. 61/906,165, filed on Nov. 19, 2013, provisional application No. 61/870,411, filed on Aug. 27, 2013.

(51) Int. Cl.

| | |
|---|---|
| ***A63B 67/00*** | (2006.01) |
| ***H05B 37/02*** | (2006.01) |
| ***F21V 33/00*** | (2006.01) |
| ***H05B 33/08*** | (2006.01) |

(52) U.S. Cl.

CPC ..... *H05B 37/0272* (2013.01); *F21V 33/008* (2013.01); *H05B 33/0803* (2013.01)

(58) Field of Classification Search

CPC ..... A63B 67/00
USPC ..... 473/465, 570, 502; 362/103
See application file for complete search history.

(56) References Cited

U.S. PATENT DOCUMENTS 3,153,745 A * 10/1964 Gurian ..... G08B 5/36 313/511
4,132,983 A * 1/1979 Shapiro ..... G08B 5/38 340/331
4,651,989 A * 3/1987 Wilson ..... A41F 9/002 2/321
4,709,307 A * 11/1987 Branom ..... A41D 27/085 362/103

(Continued)

OTHER PUBLICATIONS

Webpage download, Youtube2012 , 2012, www.youtube.com/watch?v=HVykymab7IM, 2012, 7 pages.*

(Continued)

*Primary Examiner* — Gene Kim
*Assistant Examiner* — M Chambers
(74) *Attorney, Agent, or Firm* — Brown Rudnick LLP; Adam M. Schoen

(57) ABSTRACT

The invention generally relates to an illuminated sports system. In certain embodiments, the system includes a device configured to be worn by a user that includes a first portion having a first illumination source and a second portion having first control circuitry configured to at least transmit or receive data associated with the device. The system also includes a movable piece of sports equipment including a second illumination source and second control circuitry configured to at least transmit or receive data associated with the movable piece of sports equipment. At least one of the first and second control circuitries is configured to sense when the user possesses the movable piece of sports equipment and modify an emission of at least one of the first and second illumination sources based on the user possessing the movable piece of sports equipment.

12 Claims, 11 Drawing Sheets

(56) References Cited

U.S. PATENT DOCUMENTS 5,070,436 A * 12/1991 Alexander ..... A41D 13/01 340/321
5,128,843 A * 7/1992 Guritz ..... A41D 27/085 362/103
5,316,293 A * 5/1994 Hamilton ..... A63B 43/00 446/400
5,424,922 A * 6/1995 Wise ..... G02B 6/0008 362/103
5,456,462 A * 10/1995 Wilson ..... A41F 9/002 473/502
5,615,880 A * 4/1997 Booth ..... A63B 24/0021 273/371
6,320,514 B1 * 11/2001 Flick ..... B60R 25/04 307/10.3
6,997,459 B2 * 2/2006 von Goeben ..... A63B 69/004 273/348
7,288,035 B2 * 10/2007 Young, Jr. ..... A63B 67/00 473/502
8,764,588 B2 * 7/2014 Gill ..... A63B 43/06 473/465
8,840,263 B1 * 9/2014 Jones ..... A41D 13/01 362/108
9,410,694 B2 * 8/2016 Curran ..... F21V 33/0008
2002/0094893 A1 * 7/2002 Takowski ..... A63B 67/002 473/570
2007/0060425 A1 * 3/2007 Kuenzler ..... A63B 43/00 473/570
2007/0135243 A1 * 6/2007 LaRue ..... A63B 24/0021 473/467
2007/0178967 A1 * 8/2007 Rosenberg ..... A63B 24/0087 463/39
2009/0042675 A1 * 2/2009 Baun, II ..... A63B 67/00 473/502
2009/0098957 A1 * 4/2009 Hitchcock ..... A63B 67/00 473/502
2010/0184563 A1 * 7/2010 Molyneux ..... A43B 1/0054 482/1
2012/0078393 A1 * 3/2012 Kotb ..... H05B 37/0272 700/90
2013/0130848 A1 * 5/2013 Homsi ..... A63B 43/008 473/570
2013/0225338 A1 * 8/2013 Lehmann ..... A63B 65/10 473/570
2015/0062959 A1 * 3/2015 Wilson ..... H05B 33/0803 362/570

OTHER PUBLICATIONS

Webpage download, Afterdarktechnologies , 2015, Afterdarktechnologies http://www.afterdarktechnologies.com/#intro, 3 pages.*

* cited by examiner

ILLUMINATED SPORTS SYSTEM

RELATED APPLICATIONS

The present application claims the benefit of, and priority to, U.S. Provisional Application Ser. No. 61/870,411, filed Aug. 27, 2013, and U.S. Provisional Application Ser. No. 61/906,165, filed Nov. 19, 2013, the content of each of which is incorporated by reference herein in its entirety.

FIELD OF THE INVENTION

The invention generally relates to illuminated sports systems in which an illuminated wearable device and an illuminated movable piece of sports equipment are configured to communicate with each other.

BACKGROUND

Exercise and other athletic activities are no longer only carried out during the daylight hours. It is now common for many people to exercise or engage in athletics either early in the morning or later in the evening for a variety of reasons. For example, many people are unable to engage in such activities during the daytime due, in large part, to their work and/or school schedule. Additionally, some may prefer to exercise or participate in athletics during the early morning or later evening hours, when the temperature is cooler and more comfortable.

A drawback to engaging in such activities during non-daylight hours is the low light conditions associated with early morning and evening hours, which ultimately results in low visibility. This can be particularly problematic in certain activities, such as team sports, which require high visibility during gameplay. For example, in team based sports, players are divided up into two or more teams. As such, jerseys are assigned to separate teams to distinguish one team from another. However, in low visibility conditions, such as in the evening, it may be particularly difficult for players to discern between a team member and an opponent. Accordingly, certain activities in the evening generally require an artificially lighted playing surface. However, it may be difficult for some to find access to lighted fields, resulting in the inability for some to participate in athletic activities during the evening hours.

SUMMARY

The invention generally relates to an illuminated sports system in which an illuminated wearable device and an illuminated movable piece of sports equipment are configured to communicate with each other. Aspects of the invention are accomplished with a device configured to be worn by a user that includes a first portion having a first illumination source and a second portion having first control circuitry configured to at least transmit or receive data associated with the device. The system also includes a movable piece of sports equipment including a second illumination source and second control circuitry configured to at least transmit or receive data associated with the movable piece of sports equipment. At least one of the first and second control circuitries is configured to sense when the user possesses the movable piece of sports equipment and modify an emission of at least one of the first and second illumination sources based on the user possessing the movable piece of sports equipment. In that manner, the illuminated sport systems of the invention allow for interactive games to be played, such as flag football or ultimate frisbee, in low light and/or low visibility conditions. That allows players to participate in athletic activities in the early morning and evening hours.

A distinguishing feature of the systems of the invention is that at least the wearable device (e.g., vest, jersey, glove, bracelet, etc.) and the movable piece of sports equipment (e.g., ball, disc, etc.) each include control circuitry configured to communicate (e.g., wirelessly communicate) with one another to sense when a user is in possession of the piece of sports equipment. Upon sensing possession, the control circuitry is further configured to modify emission from an illumination source on the wearable device and/or the piece of sports equipment. For example, in a competitive sports, such as football, upon a player catching a ball, control circuitry may be configured to modify an emission pattern of a light emitting diode (LED) on a jersey worn by the player and/or the ball, such that the jersey and/or the ball start to blink to indicate the player now has possession. In addition to having illumination sources, the wearable device and/or piece of sports equipment may include other output sources, such as audio output sources and haptic feedback sources. The control circuitry may be further configured modify emission of at least one of the audible sound and a haptic feedback sources based on the player having possession of the ball, in addition, or alternatively, to modifying light emissions. Thus, upon a player possessing the ball, the audio output source may emit an audible sound (e.g., audible alert) and/or the haptic feedback source may emit a haptic effect (e.g., physical vibration) so as to further provide indication of the possession of the ball.

Accordingly, the system of the invention provides players with illuminated sports equipment (e.g., wearable devices, movable piece of sports equipment, on-field sports equipment, etc.) which provide enhanced visibility in low light and/or low visibility conditions, thereby allowing players to participate in athletic activities, including competitive team based sports, in the evening hours without the need for artificial overhead lighting. Furthermore, the illuminated sports equipment is configured to communicate with one another, so as to sense player interaction with the movable piece of sports equipment (e.g., possession of ball), as well as player movement within playing surface boundaries, as defined by on-field sports equipment (e.g., player going out-of-bounds, player crossing goal line, etc.). Accordingly, the system provides an interactive playing experience to further improve gameplay, particularly in low light and/or low visibility conditions.

As generally understood, the wearable device may include any form of apparel or article of clothing, including, but not limited to, a shirt, pants, shorts, head gear, shoes, socks, gloves, and the like. The wearable device may also include jewelry-like articles, such as necklace, ring, bracelet, and the like. The movable piece of sports equipment is generally understood to be a moveable object for use in a sport or activity, which may include a ball or similar object (e.g., football, baseball, basketball, soccer ball, tennis ball, hockey puck, volleyball, bocce ball, dodge ball, etc.) or a flying object (e.g., flying disc, boomerang, etc.).

In one aspect, the wearable device includes a first portion including a first illumination source and a second portion including first control circuitry configured to at least transmit or receive data associated with the device. The movable piece of sports equipment includes a second illumination source and second control circuitry configured to at least transmit or receive data associated with the movable piece of sports equipment. At least one of the first and second control circuitries is configured to sense when the user possesses the movable piece of sports equipment and modify an emission of at least one of the first and second illumination sources based on the user possessing the movable piece of sports equipment.

In some embodiments, the first and second portions of the wearable device are physically connected to one another. In other embodiments, the first and second portions of the device are physically discrete from one another. The first and second control circuitries are each able to wirelessly transmit data with one another via a wireless transmission protocol, including, but not limited to, Bluetooth communication, infrared communication, near field communication (NFC), radio-frequency identification (RFID) communication, cellular network communication, the most recently published versions of IEEE 802.11 transmission protocol standards as of August 2014, and a combination of at least two thereof.

In one embodiment, at least one of the first and second control circuitries is configured to modify one or more emission characteristics of at least one of the first and second illumination sources based on the sensed user possession of the movable piece of sports equipment. The emission characteristics may include, but are not limited to, emission intensity, emission pattern, and emission spectrum (e.g., color). In some embodiments, the wearable device further includes at least one fiber optic cable optically coupled to the first illumination source and configured to transmit emitted light along a length thereof. In one example, the at least one fiber optic cable is a side-firing cable.

In some embodiments, at least one of the device and the movable piece of sports equipment further includes at least one of an audio output source configured to emit an audible sound and a haptic feedback source configured to emit a haptic effect. At least one of the first and second control circuitries is configured to modify an emission of at least one of the audio output and haptic feedback sources based on the user possessing the movable piece of sports equipment. Accordingly, upon sensing possession of the movable piece of sports equipment, an audible tone may be emitted from the audio output source and/or a haptic effect (e.g., vibration) may be emitted from the haptic feedback source.

In some embodiments, the wearable device further includes at least one adjustable strap element configured to releasably retain the device to the user. The adjustable strap element may further include at least one coupling portion operatively coupled to the first control circuitry and configured to releasably retain and communicate with a flag element. Accordingly, the wearable device may generally resemble a jersey for flag football, wherein the flag element may be disconnected from coupling so as to indicate a "tackle" and stopping gameplay, as an alternative to physically tackling an opponent. The flag element may include a third illumination source configured to emit light and third control circuitry configured to at least transmit or receive data associated with the flag element. In one embodiment, at least one of the first and third control circuitries is configured to sense when the flag element is disconnected from the coupling on the strap and further configured to modify one or more emission characteristics of at least one of the first and third illumination sources based on the disconnection. Additionally, or alternatively, at least one of the wearable device and the flag element includes at least one of an audio output source configured to emit an audible sound and a haptic feedback source configured to emit a haptic effect, such that, upon disconnection of the flag element from the coupling on the strap, an audible tone and/or a haptic effect are emitted to indicate the disconnection (e.g., indicate the "tackle").

In some embodiments, the first control circuitry of the wearable device may be configured to operate in a specialized mode that may be selected by the player. In the specialized mode, the first control circuitry may be configured delay modification of the emission of the first illumination source for a predefined period of time. Accordingly, in some sports, such as flag football, a quarterback may utilize this specialized mode as a means of providing a predefined countdown between when the ball is snapped and modifying the light emission on the quarterback's wearable device (e.g., jersey) so as to indicate when the defense is allowed to "tackle" the quarterback (e.g., five seconds after the ball is snapped).

In some embodiments, the system may further include on-field equipment, which may include a plurality of markers for defining one or more playing boundaries of a playing surface. For example, the markers may be used to define the outer perimeter of a playing surface (e.g., sidelines and end lines), as well as other boundaries (goal line, end zone, demarcations along length of field, etc.). The plurality of markers may be illuminated via illumination sources, and at least one of the markers may include circuitry configured to at least transmit or receive data associated with the at least one marker. The marker circuitry may be configured to wirelessly communicate with the control circuitries of the wearable device and/or movable piece of sports equipment, such that user movement within proximity of the marker may be sensed and emission of at least one of the illumination sources of the wearable device, movable piece of sports equipment, and the marker may be modified to indicate the player movement relative to the markers. For example, the illumination source of one or more markers may flash and/or change color upon a user crossing over the one or more markers, so as to indicate that the user has crossed over a boundary on the playing surface (e.g., user is out-of-bounds, user has crossed goal line, etc.).

In another aspect, the wearable device includes a first portion including a first illumination source and a second portion including a magnet. The movable piece of sports equipment includes a second illumination source, control circuitry configured to at least transmit or receive data associated with the movable piece of sports equipment, and at least one sensor configured to detect the presence of a magnetic field generated by the magnet of the wearable device. The control circuitry is configured to sense when the user possesses the movable piece of sports equipment based on the detected magnetic field and further modify an emission of the second illumination source based on the user possessing the movable piece of sports equipment.

In some embodiments, the sensor is a Hall Effect sensor configured to identify the orientation of the magnetic field. The control circuitry may be configured to modify one or more emission characteristics of the second illumination source based on at least one of the sensed user possession of the movable piece of sports equipment and the identified orientation of the magnetic field. For example, in a competitive team sport, players on one team may be wearing an article of clothing (e.g., bracelet) having a magnet with the south pole facing outwards and players on the opposing team may be wearing a bracelet having a magnet with the north pole facing outwards. Accordingly, upon a player possessing the movable piece of sports equipment (e.g., catching a ball), the Hall Effect sensor in the ball is configured to detect the magnetic field of the magnet worn by that player and the orientation of the magnetic field (e.g., south-facing or north-facing) of the magnet. The control circuitry in the ball is then configured to modify the light emission from the illumination source of the ball depending on the magnetic orientation, so as to indicate the possession. For example, if a player on Team 1 catches the ball, the ball may change color (e.g., red) to indicate Team 1 has possession and if a player on Team 1 catches the ball, the ball may change color (e.g., from red to blue) to indicate Team 2 now has possession.

DETAILED DESCRIPTION

Figure 1:
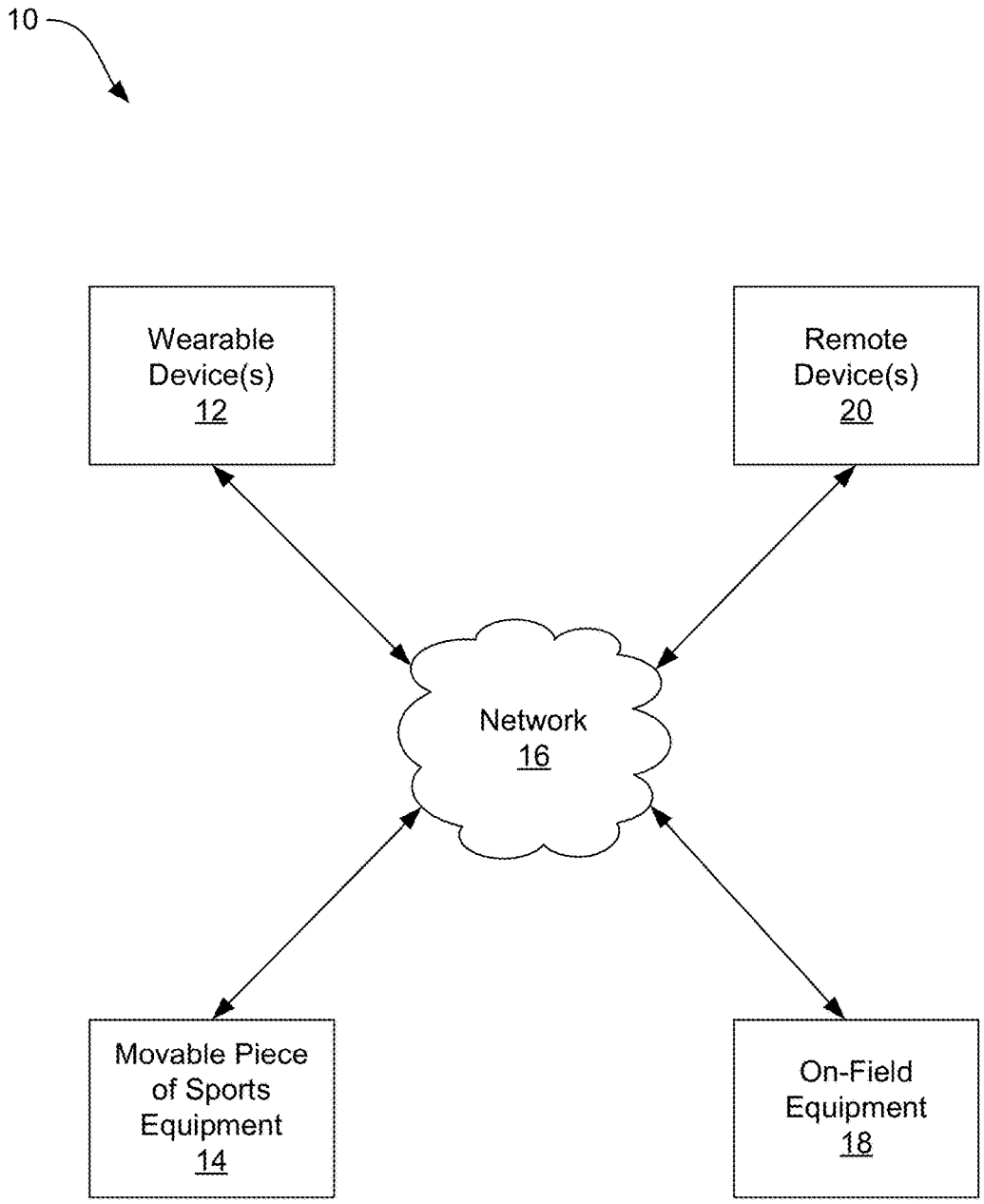
FIG. 1 is a block diagram illustrating one embodiment of an exemplary sports gaming system consistent with the present disclosure.

The invention generally relates to an illuminated sports system that includes at least one or more wearable devices, and a movable piece of sports equipment. Optionally, the system may include on-field sports equipment. Each of the components of the system may include an illumination source so as to enhance its appearance and improve visibility in low light and/or low visibility conditions, thereby allowing players to participate in athletic activities in the early morning and evening hours. Additionally, each of the one or more wearable devices and the movable piece of sports equipment has control circuitry configured to wirelessly communicate with one another and to provide an interactive experience for a user during gameplay.

Aspects of the invention include a sports gaming system including at least a device configured to be worn by a user and a movable piece of sports equipment for use in the sport. As generally understood, the wearable device may include any form of apparel or article of clothing, including, but not limited to, a shirt, vest, jersey, pants, shorts, head gear, shoes, socks, gloves, and the like. The wearable device may also include jewelry-like articles, such as necklace, ring, bracelet, and the like. The movable piece of sports equipment is generally understood to be a moveable object for use in a sport or activity, which may include a ball or similar object (e.g., football, baseball, basketball, soccer ball, tennis ball, hockey puck, volleyball, bocce ball, dodge ball, etc.) or a flying object (e.g., flying disc, boomerang, etc.).

In one aspect, the wearable device includes a first portion including a first illumination source and a second portion including first control circuitry configured to at least transmit or receive data associated with the device. The movable piece of sports equipment includes a second illumination source and second control circuitry configured to at least transmit or receive data associated with the movable piece of sports equipment. At least one of the first and second control circuitries is configured to sense when the user possesses the movable piece of sports equipment and modify an emission of at least one of the first and second illumination sources based on the user possessing the movable piece of sports equipment.

In some embodiments, the first and second portions of the wearable device are physically connected to one another. In other embodiments, the first and second portions of the device are physically discrete from one another. The first and second control circuitries are each able to wirelessly transmit data with one another via a wireless transmission protocol, including, but not limited to, Bluetooth communication, infrared communication, near field communication (NFC), radio-frequency identification (RFID) communication, cellular network communication, the most recently published versions of IEEE 802.11 transmission protocol standards as of August 2014, and a combination of at least two thereof.

In one embodiment, at least one of the first and second control circuitries is configured to modify one or more emission characteristics of at least one of the first and second illumination sources based on the sensed user possession of the movable piece of sports equipment. The emission characteristics may include, but are not limited to, emission intensity, emission pattern, and emission spectrum (e.g., color). In some embodiments, the wearable device further includes at least one fiber optic cable optically coupled to the first illumination source and configured to transmit emitted light along a length thereof. In one example, the at least one fiber optic cable is a side-firing cable.

In some embodiments, at least one of the device and the movable piece of sports equipment further includes at least one of an audio output source configured to emit an audible sound and a haptic feedback source configured to emit a haptic effect. At least one of the first and second control circuitries is configured to modify an emission of at least one of the audio output and haptic feedback sources based on the user possessing the movable piece of sports equipment. Accordingly, upon sensing possession of the movable piece of sports equipment, an audible tone may be emitted from the audio output source and/or a haptic effect (e.g., vibration) may be emitted from the haptic feedback source.

Accordingly, the system of the invention provides players with illuminated sports equipment (e.g., wearable devices, movable piece of sports equipment, on-field sports equipment, etc.) which provide enhanced visibility in low light and/or low visibility conditions, thereby allowing players to participate in athletic activities, including competitive team based sports, in the evening hours without the need for artificial overhead lighting. Furthermore, the illuminated sports equipment is configured to wireless communicate with one another, so as to sense player interaction with the movable piece of sports equipment (e.g., possession of ball), as well as player movement within playing surface boundaries, as defined by on-field sports equipment (e.g., player going out-of-bounds, player crossing goal line, etc.). Accordingly, the system provides an interactive playing experience to further improve gameplay, particularly in low light and/or low visibility conditions.

FIG. 1 is a block diagram illustrating one embodiment of an exemplary sports gaming system 10. As shown, the system 10 includes a wearable device 12 configured to communicate and share data with at least a movable piece of sports equipment 14 over a network 16. In the present context, the wearable device 12 may include any form of apparel or article of clothing, including, but not limited to, a shirt, pants, shorts, head gear, shoes, socks, gloves, and the like. The wearable device 12 may also include jewelry-like articles, such as necklace, ring, bracelet, and the like. Additionally, the movable piece of sports equipment 14 is generally understood to be a moveable object, such as a throwable object, for use in a sport or activity, which may include a ball or similar object (e.g., football, baseball, basketball, soccer ball, tennis ball, hockey puck, volleyball, bocce ball, dodge ball, etc.) or a flying object (e.g., flying disc, boomerang, etc.).

The wearable device 12 may further be configured to communicate and share data with on-field equipment 18 and/or one or more remote devices 20 via the network 16. The on-field equipment 18 is different than the movable piece of sports equipment 14, in that the on-field equipment 18 includes equipment used at least for defining one or more playing boundaries of a playing surface for any given athletic activity. For example, on-field equipment may be used to define the outer perimeter of a playing surface (e.g., sidelines and end lines), as well as other boundaries (goal line, end zone, demarcations along length of field, etc.).

The one or more remote devices 20 is understood to be any type of device for communicating with at least the wearable device 12 (as well as the movable piece of sports equipment 14, and/or on-field equipment 18) over the network 16. For example, a remote device 20 may be embodied as, without limitation, a computer, a desktop computer, a personal computer (PC), a tablet computer, a laptop computer, a notebook computer, a mobile computing device, a smart phone, a cellular telephone, a handset, a messaging device, a work station, a distributed computing system, a multiprocessor system, a processor-based system, and/or any other computing device configured to store and access data, and/or to execute software and related applications consistent with the present disclosure.

In some embodiments, the remote device 20 may be configured to receive data from at least one of the wearable device 12, the movable piece of sports equipment 14, and on-field equipment 18, and further analyze the received data to provide statistical analysis to a user based on the received data. For example, in some embodiments, the wearable device 12 may include sensors for capturing data related to the user's vitals and or physical movement, such as a heart rate monitor, a blood pressure monitor, a temperature sensor, a pedometer, and the like. The remote device 20 can receive the data and further provide statistics related to the user's health based on the data (e.g., heart rate, calories burned, etc.).

In some embodiments, the wearable device 12 may further include motion and/or location sensing devices for providing data related to the user's movement on the playing field. For example, the wearable device 12 may include an accelerometer or other motion or movement sensor to produce sensory signals corresponding to motion or movement of the user, a magnetometer to produce sensory signals from which direction of travel or orientation can be determined, a gyroscope configured to sense angular velocity of the wearable device 12, and/or a global positioning system (GPS) sensor for determining location of the user relative to a playing surface. The remote device 20 can receive the location data, in addition to data related to user possession of the moveable piece of sports equipment 14 and/or movement relative to the on-field equipment 18, and further provide statistics related to the user's on-field performance (e.g., catches made, times scored, distance traveled on field, location on the field, etc.) in real- or near real-time. Accordingly, the system of the present invention provides collection of player statistics in real- or near real-time, such that players may track their performance during and/or after gameplay. Player performance and statistics may be collected throughout a season of games, such that statistics may be provided league-wide for any given athletic competition during a season (e.g., flag football, Ultimate, etc.). Additionally, one or more spectators off-field may track any particular player during gameplay and have access to player statistics at any given moment.

The network 16 may be any network that carries data. Non-limiting examples of suitable networks that may be used as network 16 include Wi-Fi wireless data communication technology, the internet, private networks, virtual private networks (VPN), public switch telephone networks (PSTN), integrated services digital networks (ISDN), digital subscriber link networks (DSL), various second generation (2G), third generation (3G), fourth generation (4G) cellular-based data communication technologies, Bluetooth radio, Near Field Communication (NFC), other networks capable of carrying data, and combinations thereof. In some embodiments, network 16 is chosen from the internet, at least one wireless network, at least one cellular telephone network, and combinations thereof. As such, the network 16 may include any number of additional devices, such as additional computers, routers, and switches, to facilitate communications. In some embodiments, the network 16 may be or include a single network, and in other embodiments the network 16 may be or include a collection of networks.

As described in greater detail herein, at least the wearable device 12 is configured to be worn by a user during an athletic activity, such as a team-based sporting event. The wearable device 12 and the movable piece of sports equipment 14 are each configured to wirelessly communicate with one another and further sense user possession of the movable piece of sports equipment and provide an output indicating that the user has possession in real- or near real-time during gameplay, so as to provide an interactive experience for one or more participants during gameplay.

Figure 2:
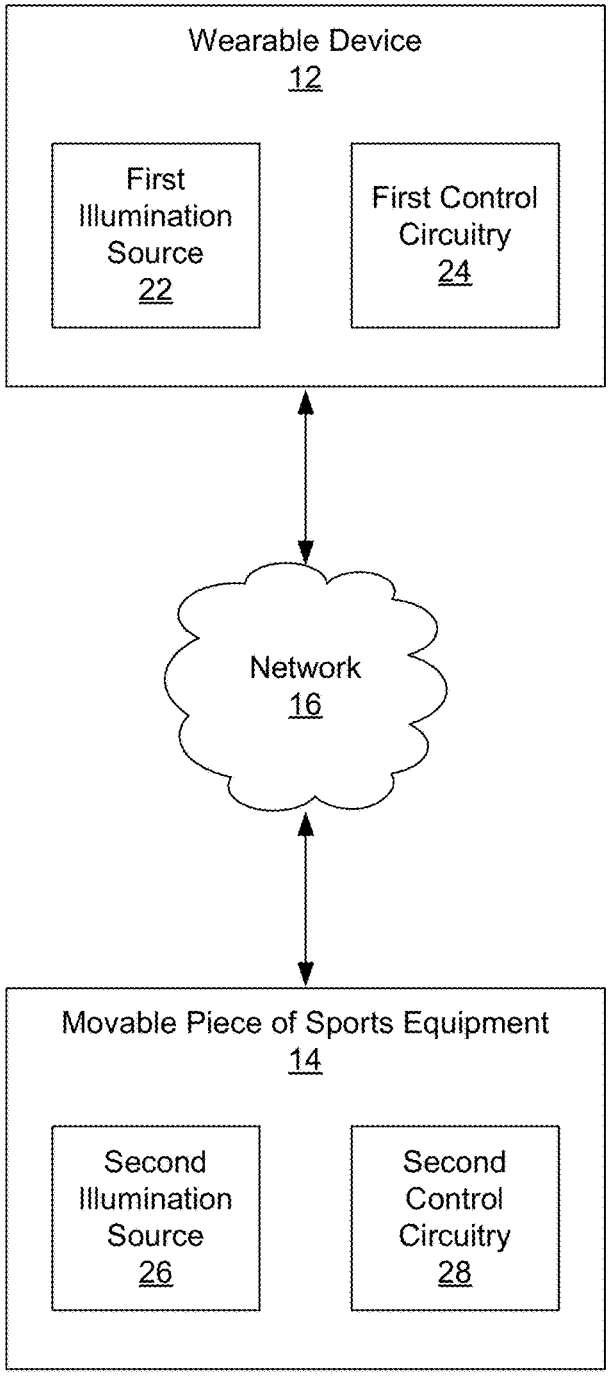
FIG. 2 is a block diagram illustrating the wearable device and movable piece of sports equipment of the system of FIG. 1 in greater detail.

FIG. 2 is a block diagram illustrating the wearable device 12 and movable piece of sports equipment 14 of the system 10 of FIG. 1 in greater detail. As shown, the wearable device 12 includes a first portion including a first illumination source 22 and a second portion including first control circuitry 24 configured to at least transmit or receive data associated with the device 12. In one embodiment, the first and second portions of the device 12 are physically connected to one another. For example, the wearable device 12 may include a shirt having one or more portions illuminated by the first illumination source 22. The first illumination source 22 may be physically connected to the first control circuitry 24 included within an enclosure, or the like, on the shirt. For example, the first illumination source 22 and first control circuitry 24 may be included on a printed circuit board (PCB) which is physically connected to the shirt. In other embodiments, the first and second portions of the wearable device 12 may be physically discrete from one another. Accordingly, in the above example, the first illumination source 22 and the first control circuitry 24 may be separate from one another.

As shown, the movable piece of sports equipment 14 includes a second illumination source 26 and second control circuitry 28 configured to at least transmit or receive data associated with the movable piece of sports equipment 14. The first and second illumination sources 22, 26 may include any known device configured to emit light and/or transmit light. For example, in one embodiment, the first and second illumination sources 22, 26 may include one or more light emitting diodes (LEDs). It should be noted that in other embodiments, the first and second illumination sources 22, 26 may include other types of light emitting devices. For example, in one embodiment, in addition, or alternatively, to LEDs, the wearable device 12 may include an electroluminescent (EL) component, such as an EL panel (not shown). The EL panel may be configured to emit light in a distinct pattern so as to convey informational data. For example, the EL panel may be used to provide markings, indicia, logos, and the like. In one embodiment, the EL panel may be used to provide a number or a name, such that the wearable device 12 resembles a jersey and the user can have their favorite number and their name or their team name and/or logo included.

At least one of the first and second control circuitries 24, 28 is configured to sense when a user (wearing the wearable device 12) possesses the movable piece of sports equipment 14. As described in greater detail herein, the first and second control circuitries 24, 28 are configured to wirelessly communicate with one another so as to exchange data to determine user possession. For example, the first and second control circuitries 24, 28 each include communication circuitry configured to wirelessly transmit and/or receive data via a wireless transmission protocol. The wireless transmission protocol may include, but is not limited to, Bluetooth communication, infrared communication, near field communication (NFC), radio-frequency identification (RFID) communication, cellular network communication, the most recently published versions of IEEE 802.11 transmission protocol standards as of August 2014, and a combination of at least two thereof.

Upon sensing possession of the movable piece of sports equipment 14, at least one of the first and second control circuitries 24, 28 is configured to modify an emission of at least one of the first and second illumination sources 22, 26 based on the user possessing the movable piece of sports equipment 14. More specifically, at least one of the first and second control circuitries 24, 28 is configured to modify one or more emission characteristics of at least one of the first and second illumination sources 22, 26 based on the sensed user possession of the movable piece of sports equipment 14. The emission characteristics of the illumination sources 22, 26 may include, but are not limited to, emission intensity, emission pattern, emission spectrum, and a combination of at least two thereof. Accordingly, upon sensing a user possessing the movable piece of sports equipment 14, the first control circuitry 24 is further configured to modify the emission of light from the first illumination source 22 on the wearable device 12. The modification may result in an adjustment to light emission intensity (e.g., increase brightness), adjust the light emission pattern (e.g., transition from steady light to a blinking light emission), and/or a change in light emission spectrum (e.g., change color of light). Additionally, or alternatively, the light emission from the second illumination source 26 of the piece of sports equipment 14 may be modified in a similar manner. Modification of the light emission provides a visual indication to players during gameplay as to who has the piece of sports equipment (e.g., ball) and where that player is on the playing surface, which can be particularly useful during low light and low visibility conditions.

Figure 3:
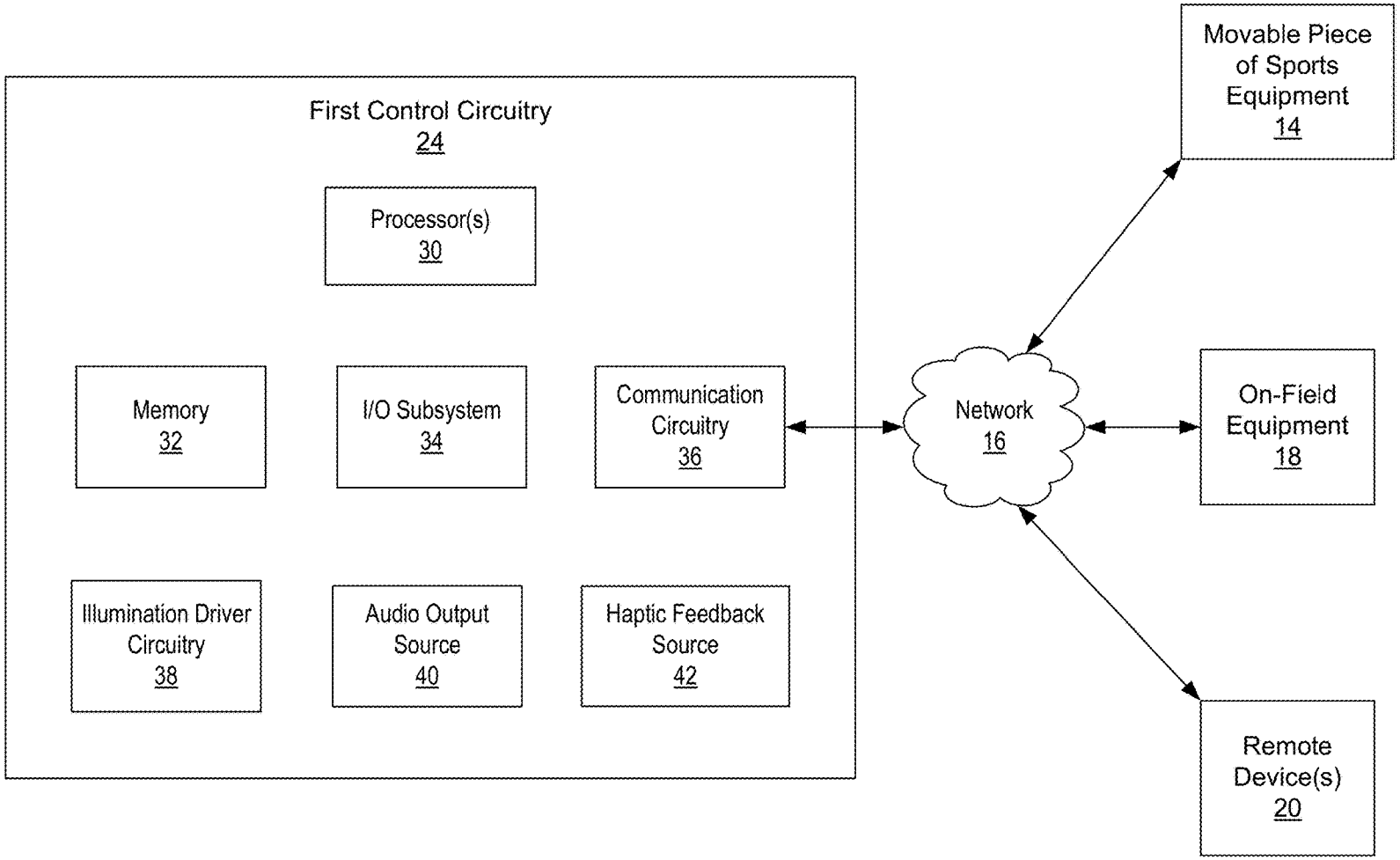
FIG. 3 is a block diagram illustrating one embodiment of the first control circuitry of the wearable device of the system of FIG. 1 consistent with the present disclosure.

FIG. 3 is a block diagram illustrating one embodiment of the first control circuitry 24 of the wearable device 12 of the system 10 of FIG. 1. It should be noted that other control circuitries described herein (e.g., second control circuitry 28 of the movable piece of sports equipment) may be similarly configured as the first control circuitry 24 shown in FIG. 3. However, for ease of description, details of only the first control circuitry 24 will be described. As shown, the first control circuitry 24 includes a processor 30, a memory 32, an input/output subsystem 34, communication circuitry 36, illumination driver circuitry 38, an audio output source 40, and a haptic feedback source 42. As generally understood, the first control circuitry 24 may include fewer, other, or additional components, such as those commonly found in conventional computer systems. Additionally, in some embodiments, one or more of the illustrative components may be incorporated in, or otherwise from a portion of, another component. For example, the memory 32, or portions thereof, may be incorporated into the processor 30 in some embodiments.

The processor 30 may be embodied as any type of processor capable of performing the functions described herein. For example, the processor may be embodied as a single or multi-core processor(s), digital signal processor, microcontroller, or other processor or processing/controlling circuit. Similarly, the memory 32 may be embodied as any type of volatile or non-volatile memory or data storage capable of performing the functions described herein. In operation, the memory 32 may store various data and software used during operation of the first control circuitry 24 such as operating systems, applications, programs, libraries, and drivers. The memory 32 is communicatively coupled to the processor 30 via the I/O subsystem 34, which may be embodied as circuitry and/or components to facilitate input/output operations with the processor 30, the memory 32, and other components of the first control circuitry 24.

For example, the I/O subsystem 34 may be embodied as, or otherwise include, memory controller hubs, input/output control hubs, firmware devices, communication links (i.e., point-to-point links, bus links, wires, cables, light guides, printed circuit board traces, etc.) and/or other components and subsystems to facilitate the input/output operations. In some embodiments, the I/O subsystem 34 may form a portion of a system-on-a-chip (SoC) and be incorporated, along with the processor 30, the memory 32, and other components of first control circuitry 24, on a single integrated circuit chip.

The communication circuitry 36 of the first control circuitry 24 may be embodied as any communication circuit, device, or collection thereof, capable of enabling communications between the first control circuitry 24 and movable piece of sports equipment 14, on-field equipment 18, and/or remote device 20 via the network 16. The communication circuitry 36 may be configured to use any one or more communication technology and associated protocols, as described above, to effect such communication. For example, the communication circuitry 36 may be configured to wirelessly transmit and/or receive data via a wireless transmission protocol. The wireless transmission protocol may include, but is not limited to, Bluetooth communication, infrared communication, near field communication (NFC), radio-frequency identification (RFID) communication, cellular network communication, the most recently published versions of IEEE 802.11 transmission protocol standards as of August 2014, and a combination of at least two thereof.

The illumination driver circuitry 38 may be embodied as any type of driver configured to control output to the first illumination source 22 so as to control operation of the first illumination source 22 and further modify emission characteristics of emitted light from the first illumination source 22.

The audio output source 40 may be embodied as any type of audio source (e.g., speaker or the like) configured to emit an audible tone. The haptic feedback source 42 may include any known device configured to generate haptic effects, including, but not limited to, mechanical vibration and electrical stimulation. Accordingly, in addition to having illumination sources, at least the wearable device 12 may include other output sources, such as the audio output and haptic feedback sources 40, 42. The first control circuitry 24 may be further configured modify emission of at least one of the audible sound and a haptic feedback sources 40, 42 based on the player having possession of the ball, in addition, or alternatively, to modifying light emissions. Thus, upon a player possessing the ball, the audio output source 40 may emit an audible sound (e.g., audible alert) and/or the haptic feedback source 42 may emit a haptic effect (e.g., physical vibration) so as to further provide indication of the possession of the ball. In one embodiment, the haptic feedback source 42 includes a vibration actuator configured to generate vibrational effects. For example, the vibration actuator may be configured to generate vibrational effects based on user possession of the movable piece of sports equipment 14.

As described in greater detail herein, other components of a system consistent with the present disclosure may also include audio and/or haptic feedback sources similar to those of the wearable device 12 and configured to provide audible and/or haptic effects based on user possession, as well as other events, such as a user passing a defined boundary line on the playing surface.

The first control circuitry 24 may maintain one or more application programs, databases, media and/or other information in the memory 32. One or more applications related to light emission programs, audible sounds/tones, and/or haptic effects, including configurations and/or settings of light emission, sounds, and/or haptic effects, may be stored in the memory 32 and utilized for controlling the illumination driver 38, audio output source 40, and/or the haptic feedback source 42.

Figure 4:
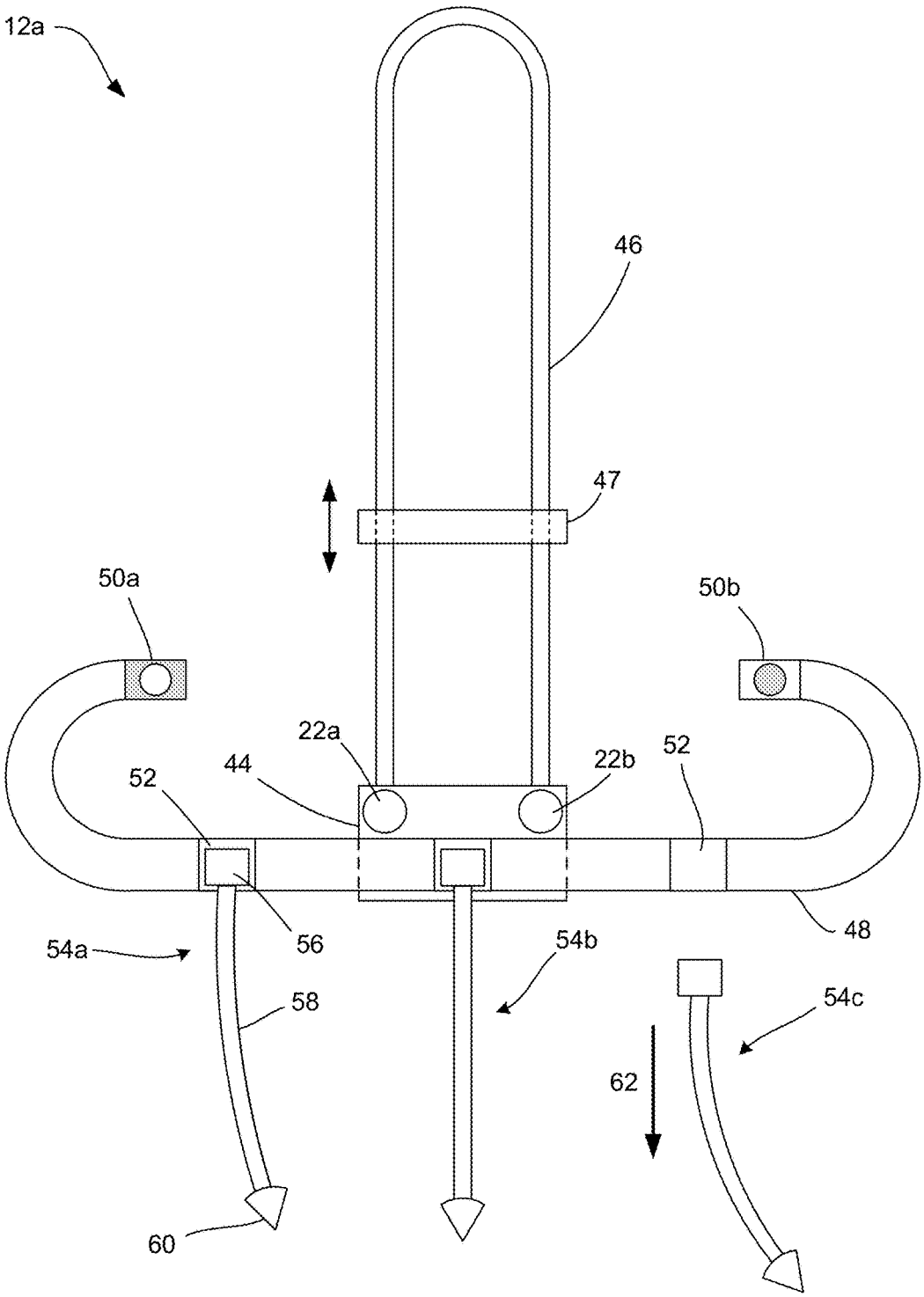
FIG. 4 is an exemplary illustration of one embodiment of a wearable device consistent with the present disclosure including releasable flag elements.

FIG. 4 is an exemplary illustration of one embodiment of a wearable device 12*a* consistent with the present disclosure including releasable flag elements 54*a*-54*c*. As shown, the wearable device 12*a* may be in the form of a jersey to be worn over a user's torso (shown in FIGS. 6A and 6B). In the illustrated embodiment, the device 12*a* may include at an enclosure 44 for housing at least one of the first illumination source (illustrated as LEDs 22*a* and 22*b*) and the first control circuitry 24. As generally understood, the enclosure 44 may have a removable portion for allowing access to the illumination source 22 and/or control circuitry 24, as well as any other additional components, such as a rechargeable battery unit for providing power to the illumination source 22 and/or first control circuitry 24.

The device 12*a* further includes at least one fiber optic cable 46 optically coupled to the first illumination source (shown as LEDs 22*a* and 22*b*) and configured to transmit emitted light along a length thereof. In one embodiment, the fiber optic cable 46 is a side-firing cable. The fiber optic cable 46 is configured to receive emitted light from the first illumination sources 22*a*, 22*b* and provide illumination along a length thereof. As described in greater detail herein (and shown in FIGS. 6A-6B) the fiber optic cable 46 is configured to extending from the user's back, over the user's shoulders, and extend across the he user's chest/stomach. The device 12*a* may further include a guide element 47 configured to allow adjustment of the cable 46, depending on the dimensions of any given user (e.g., height, width, weight, etc.), so as to maintain securement of the device 12*a* to the user. For example, the guide element 47 may include one or more apertures shaped and/or sized for receiving a portion of the cable 46 there through, such that the guide element 47 may translate along a length of the cable 46 so as to increase/decrease tension on the cable 46 so as to be sized to any given user to prevent the cable 46 from falling off of a user's shoulders when the device 12*a* is worn.

The device 12*a* may further include at least one adjustable strap element 48 configured to releasably retain the at least the first illumination source 22 and first control circuitry 24 to the user. The adjustable strap 48 may include a buckle-like assembly 50*a*, 50*b* for coupling both ends of the strap element 48 to one another for securing to the user. For example, the buckle assembly may include a first female end 50*a* configured to releasably retain a corresponding male end 50*b* in a snap-fit like manner (e.g., parachute clips). In one embodiment, the It should be noted that other known coupling configurations are contemplated herein.

The strap element 48 further includes at least one coupling 52 element operatively coupled to the first control circuitry and configured to releasably retain and communicate with a flag element 54. For example, the couplings 52 may be arranged along a length of the strap 48 and may be configured to provide both a physical connection, as well as an electrical communication, for the flag elements 54*a*-54*c*. For example, each flag element 54*a*-54*c* may include a connecting end 56 configured to be make a physical, and electrical connection, with a corresponding coupling 52 on the strap 48. In one embodiment, the connection between the coupling 52 and the connecting end 56 of the flag element 54 may include a magnetic coupling configuration. However, it should be noted that any known coupling technique for allowing both a releasable physical and electrical connection is contemplated herein.

Figure 5:
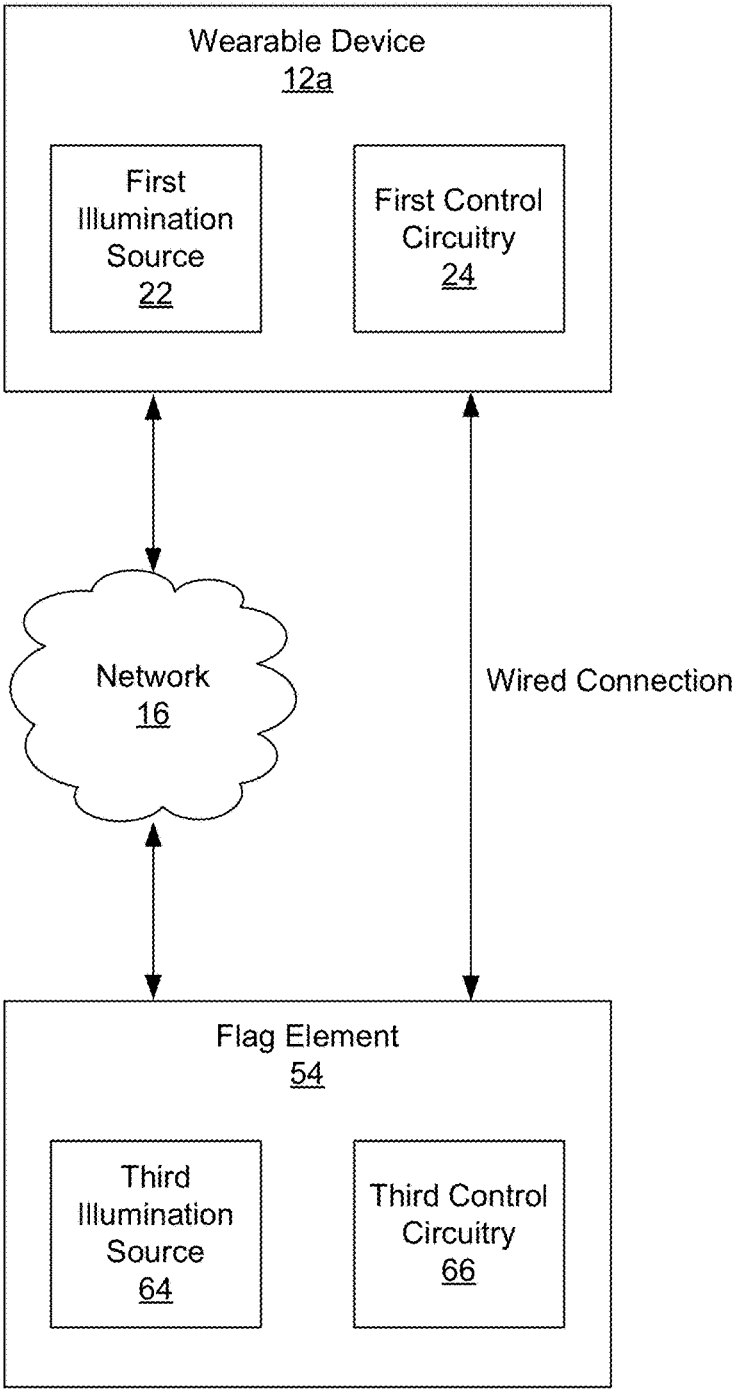
FIG. 5 is block diagram illustrating the wearable device and the flag element of FIG. 4 in greater detail.

The flag element 54 may further include a third illumination source configured to emit light and third control circuitry configured to at least transmit or receive data associated with the flag element (shown in FIG. 5). The flag element 54 may further include a fiber optic cable 58 optically coupled to the third illumination source and configured to transmit emitted light along a length thereof. The flag element 54 may further include a distal end 60 configured to capture light transmitted along the cable 58 and further produce a glow effect, so as to provide improved visibility of the flag element 54 during play. Accordingly, the device 12*a* of FIG. 4 is a jersey for use in flag football, wherein one of the flag elements 54 may be disconnected from the coupling 52, as indicated by arrow 62, so as to indicate a "tackle" and stopping gameplay, as an alternative to physically tackling an opponent. Although not shown, the flag element 54 may further include power source, such as a rechargeable battery, for providing power to at least the third illumination source.

FIG. 5 is block diagram illustrating the wearable device 12*a* and the flag element 54 of FIG. 4 in greater detail. As shown, the wearable device 12*a* is configured to communicate with the flag element 54 via the network, or a via a wired connection (via the direct connection between the flag element 54 and coupling 52 on the strap 48). The flag element 54 includes a third illumination source 64 and third control circuitry 66 configured to at least transmit or receive data associated with the flag element 54. The third control circuitry 66 may be similarly configured as the first control circuitry 24 previously described herein and shown in FIG. 3. Accordingly, in one embodiment, at least one of the first and third control circuitries 24, 66 is configured to sense when the flag element 54 is disconnected from the coupling 52 on the strap 48 and further configured to modify one or more emission characteristics of at least one of the first and third illumination sources 22, 64 based on the disconnection. For example, while the flag element 54 is connected to the coupling 52, the first and third control circuitries 24, 66 may be directly connected to one another via a wired connection. The flag element 54 may receive power from a primary power source of the device 12*a*. Upon disconnection of the flag element 54 from the coupling 52, the first and/or third control circuitries 24, 66 may sense a change in current flow, and thereby sense the disconnection. In other embodiments, the first and/or third control circuitries 24, 66 may be configured to sense movement of the flag element out of a predefined proximity to the coupling 52, and thus determine the disconnection.

Upon sensing the disconnection, at least one of the first and third control circuitries 24, 66 may be configured to modify one or more emission characteristics of at least one of the first and third illumination sources 22, 64 based on the disconnection. Accordingly, the third control circuitry 66 may be configured to adjust the light emission of the third illumination source 64 (e.g., increase brightness, change from steady light to a blinking light, change color, etc.). Additionally, or alternatively, the first control circuitry 24 may modify the first illumination source 22 to indicate the disconnection of the flag element 54, thereby improving the visibility of a "tackle", particularly in low light, low visibility conditions.

Additionally, or alternatively, the flag element 54 may further include at least one of an audio output source configured to emit an audible sound and a haptic feedback source configured to emit a haptic effect, such that, upon disconnection of the flag element from the coupling on the strap, an audible tone and/or a haptic effect are emitted to indicate the disconnection (e.g., indicate the "tackle"). Similarly, the device 12*a* may emit a sound and/or haptic effect so as to provide indication to a user and surrounding players of the flag element 54 disconnection.

Figure 6B:
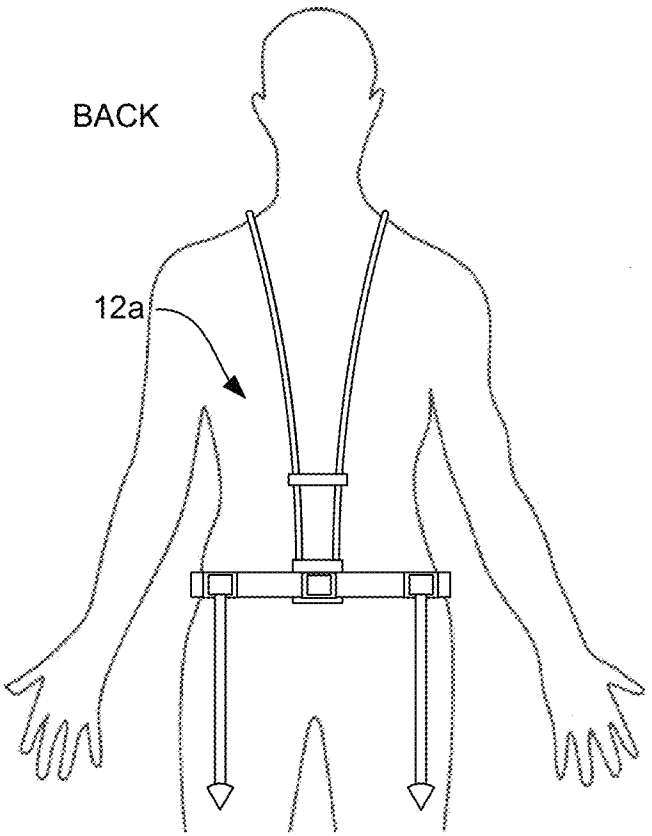
FIGS. 6A and 6B depict front and back views of a user wearing the wearable device of FIG. 4.
Figure 6A:
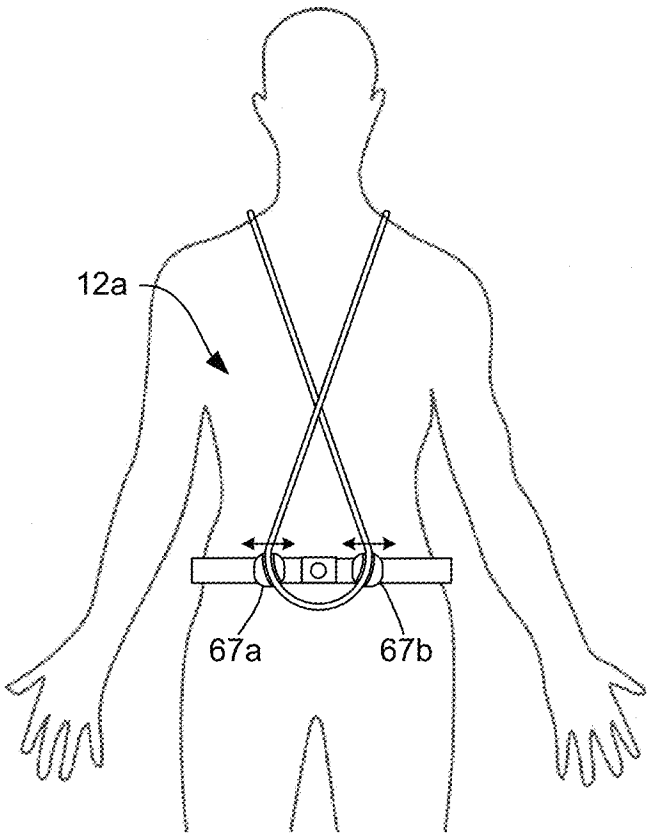

FIGS. 6A and 6B depict front and back views of a user wearing the wearable device 12*a* of FIG. 4. As shown, a user may secure the device 12*a* to their torso via the strap element 48. Additionally, the fiber optic cable 46 is shown extending from the user's back, over the user's shoulders, and resting on the user's chest/stomach. Furthermore, the fiber optic cable 46 may be twisted on the front portion and further held in place by a pair of restraint elements 67*a*, 67*b* positioned on the strap 48. As shown, the pair of restraint elements 67*a*, 67*b* reside on the strap element 48, generally one either side of the coupling elements 50*a*, 50*b*. Each restraint element 67 is configured to receive and releasably retain a portion of the cable 46 thereto via a snap-fit coupling, or other releasable coupling method. In one embodiment, each restraint element 67*a*, 67*b* may include a channel having a contour corresponding to a contour of a portion of the cable 46 when the cable is twisting on the front portion of the user. As shown, restraint elements 67*a*, 67*b* have arcuate channels shaped and/or sized to receive corresponding portions of the cable 46 and further configured to retain the cable thereto, so as to secure the cable 46 to the user. Further, each restraint element 67*a*, 67*b* is adjustable and configured to move along a length of the strap element 48, so as to allow a user to adjust the tightness of the cable 46 over their shoulders. As the restraint elements 67*a*, 67*b* move away from the buckling assembly 50*a*, 50*b*, the cable 46 may tighten and as the restraint elements 67*a*, 67*b* move toward the buckling assembly 50*a*, 50*b*, the cable 46 may loosen. Accordingly, the restraint elements 67*a*, 67*b* may provide an additional means of adjusting the device 12*a* to fit to users of all sizes. By twisting the cable 46, other players may be able to distinguish the front of the player versus the rear, so as to have an indication as to whether a player is running away from them or towards them.

Figure 6C:
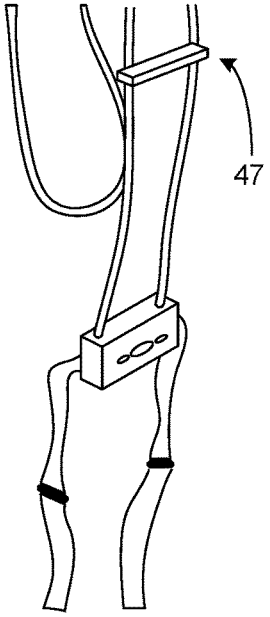
FIG. 6C depicts a perspective view of the device of FIG. 4 showing a cable guide element.

FIG. 6C depicts a perspective view of the device 12*a* of FIG. 4 showing the cable guide element 47. As shown, the guide element 47 include apertures shaped and/or sized for receiving corresponding portions the cable 46 there through, such that the guide element 47 may translate along a length of the cable 46 so as to increase/decrease tension on the cable 46 so as to be sized to any given user to prevent the cable 46 from falling off of a user's shoulders when the device 12*a* is worn.

Figure 6D:
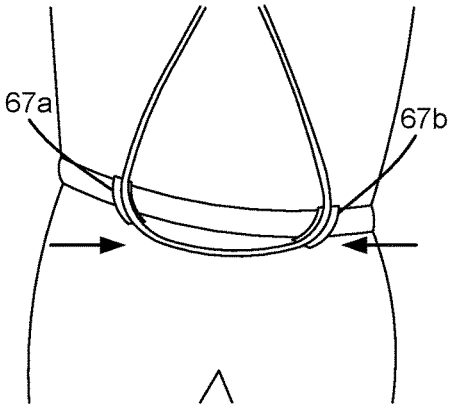
FIGS. 6D and 6E depict front views of a user wearing the device of FIG. 4 illustrating adjustment of restraint elements for decreasing/increasing tension of the cable.
Figure 6E:
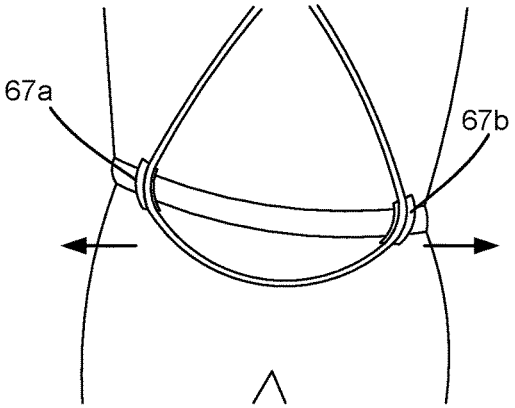

FIGS. 6D and 6E depict front views of a user wearing the device 12*a* of FIG. 4 showing adjustment of the restraint elements 67*a*, 67*b* for increasing/decreasing tension of the cable 46. FIG. 6D illustrates adjustment of the restraint elements 67*a*, 67*b*, moving toward the buckling assembly so as to loosen tension of the cable 46 to fit someone of a larger size. FIG. 6E illustrates adjustment of the restraint elements 67*a*, 67*b*, moving away from the buckling assembly so as to increase tension of the cable 46 to fit someone of a smaller size.

It should be noted that, at least the first control circuitry 24 of the wearable device 12 may be configured to operate in a specialized mode, wherein the first control circuitry 24 delays modification of the emission of the first illumination source for a predefined period of time. For example, in some embodiments, the first control circuitry 24 of the wearable device 12 may be configured to operate in a specialized mode that may be selected by the player. In the specialized mode, the first control circuitry 24 may be configured delay modification of the emission of the first illumination source 22 for a predefined period of time. Accordingly, in some sports, such as flag football, a quarterback may utilize this specialized mode as a means of providing a predefined countdown between when the ball is snapped and modifying the light emission on the quarterback's wearable device (e.g., jersey) so as to indicate when the defense is allowed to "tackle" the quarterback (e.g., five seconds after the ball is snapped).

Figure 7:
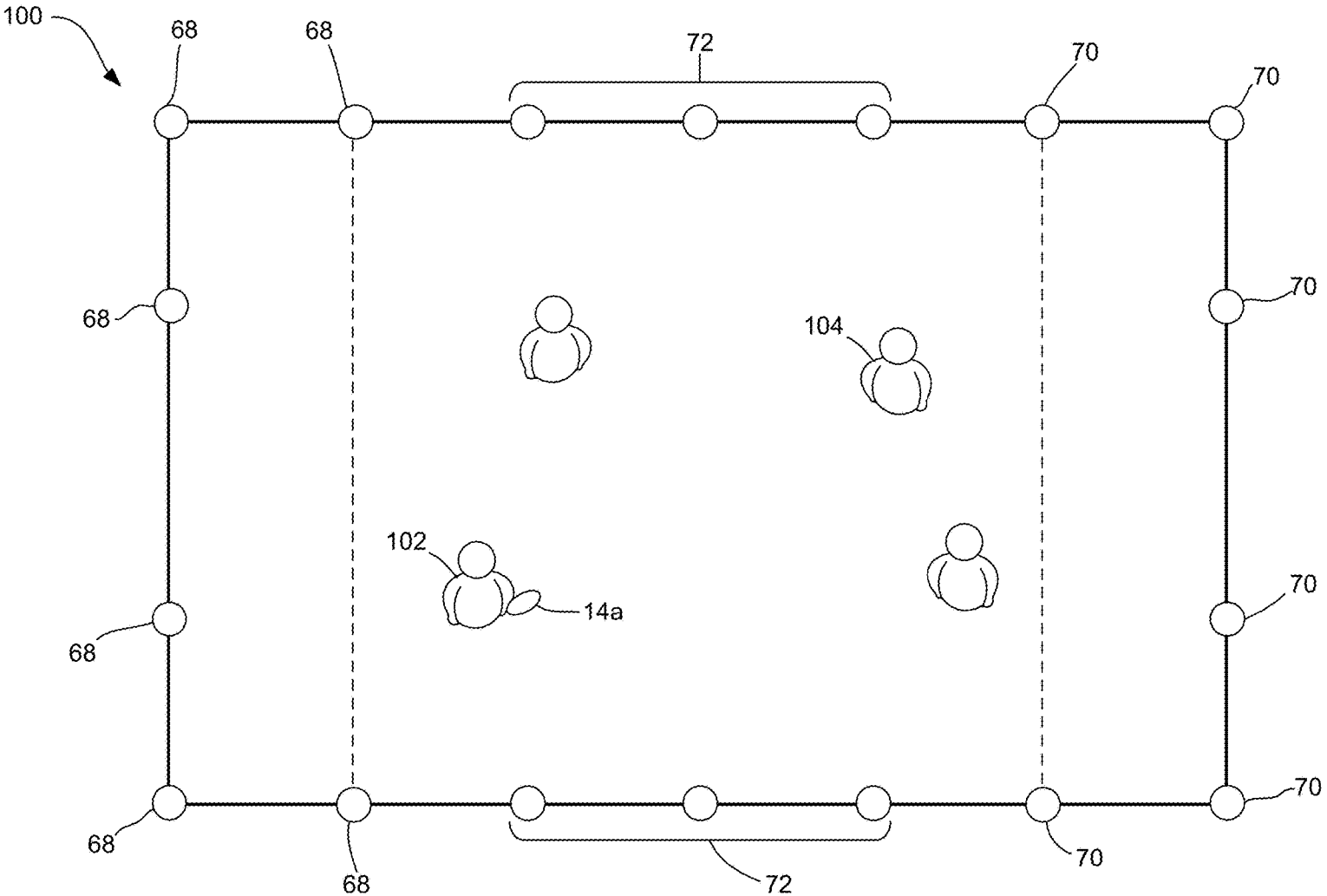
FIG. 7 is an illustration showing a playing surface for an athletic activity having one or more boundaries defined by on-field sports equipment consistent with the present disclosure.

FIG. 7 is an illustration showing a playing surface 100 for an athletic activity having one or more boundaries defined by on-field sports equipment 18 consistent with the present disclosure. As used herein, the term "on-field equipment" generally refers to equipment used to define one or more playing boundaries of the playing surface 100. As shown, the on-field equipment includes a plurality of markers 68, 70, 72 used to define different boundaries of the playing surface 100. For example, each end zone is defined by markers 68 and 70. The sidelines of the playing surface 100 are defined by markers 72. Furthermore, markers 72 may define demarcations of the playing surface 100, such as yardage as used in football. As shown, player 102 on one team may have the movable piece of sports equipment 14*a* (e.g., football) and an opposing player 104 may be defending player 102 from scoring.

As described in greater detail herein, the plurality of markers 68, 70, and 72 may be illuminated via illumination sources, and at least some of the markers may include circuitry configured to at least transmit or receive data associated with the marker. For example, markers 68 and 70, which define the end zones of the playing surface 100, may be different colors (e.g., blue and red respectively) and provide a visual indication of each team's end zone. Markers 72 may be of a third color (e.g., green) so as to provide a visual indication of the sidelines.

The marker circuitry may be configured to wirelessly communicate with the control circuitries of the wearable device 12 and/or movable piece of sports equipment 14, such that user movement within proximity of the marker may be sensed and emission of at least one of the illumination sources of the wearable device, movable piece of sports equipment, and the marker may be modified to indicate the player movement relative to the markers. For example, the illumination source of one or more markers may flash and/or change color upon a user crossing over the one or more markers, so as to indicate that the user has crossed over a boundary on the playing surface (e.g., user is out-of-bounds, user has crossed goal line, etc.). Furthermore, the first control circuitry 24 of the device 12 may be configured emit a sound and/or haptic effect so as to provide indication to a user and surrounding players of a player crossing any particular boundary.

Figure 8:
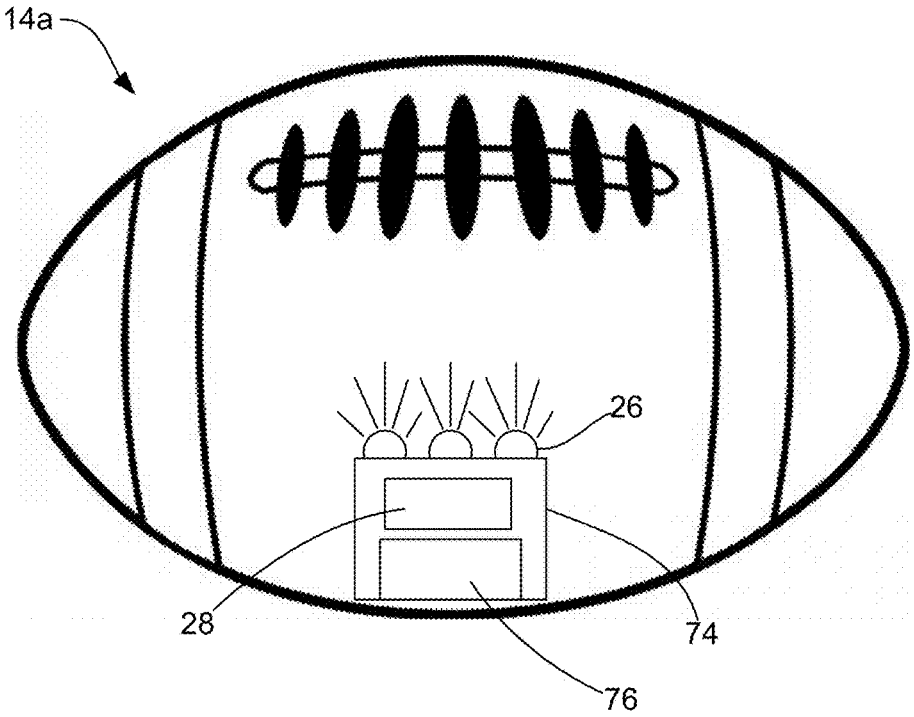
FIG. 8 is an illustration of one embodiment of a movable piece of sports equipment consistent with the present disclosure.

FIG. 8 is an illustration of one embodiment of a movable piece of sports equipment 14*a* consistent with the present disclosure. As shown, the piece of sports equipment 14*a* is a football. The football 14*a* may generally include an enclosure 74 for housing at least one of the second illumination source 26 and the second control circuitry 28. The enclosure 74 may further include a power source 76 (e.g., rechargeable battery) for providing power to at least one of the second illumination source 26 and second control circuitry 28. The football 14*a* may include a material configured to transmit or carry light emitted from the second illumination source 26 so as to provide an illuminated effect.

Figure 9:
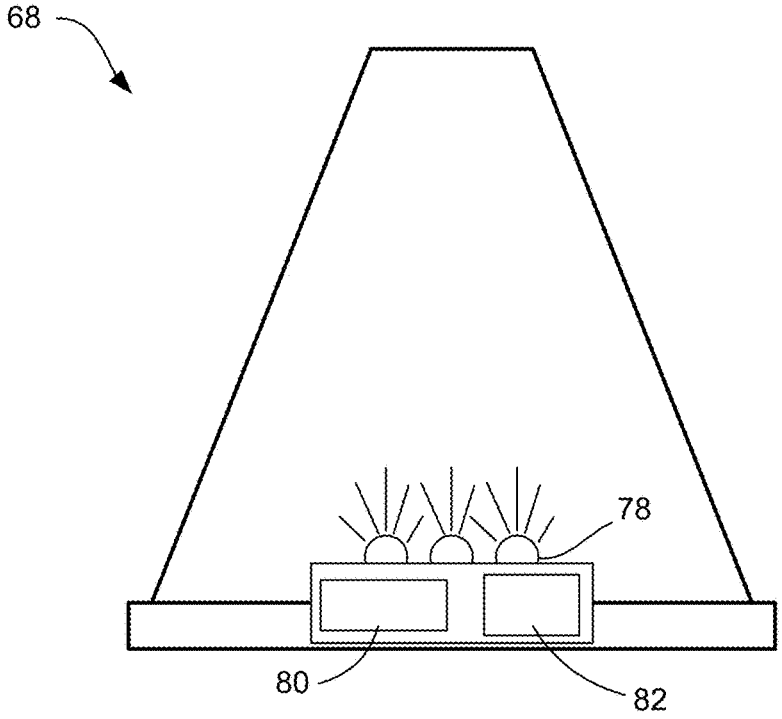
FIG. 9 is an illustration of one embodiment of a marker used to define at least one boundary of the playing surface of FIG. 7.

FIG. 9 is an illustration of one embodiment of a marker 68 used to define at least one boundary of the playing surface 100 of FIG. 7. As shown, the marker 68 may be a cone, or the like, having a fourth illumination source 78 and fourth control circuitry 80 configured to at least transmit or receive data associated with the at least one marker. The fourth control circuitry 80 may be configured to wirelessly communicate with the control circuitries of the wearable device 12 and/or movable piece of sports equipment 14, such that user movement within proximity of the marker 68 may be sensed and emission of at least one of the illumination sources of the wearable device 12, movable piece of sports equipment 14, and the marker 68 may be modified to indicate the player movement relative to the markers. For example, the fourth control circuitry 80 may be configured to modify one or more emission characteristics of light emitted by the fourth illumination source 78 based on user movement over the marker 68. For example, the fourth control circuitry 80 may be configured to cause light emitted by the fourth illumination source 78 to increase in brightness, flash, and/or change color upon a user crossing over the marker 68, so as to indicate that the user has crossed over a boundary on the playing surface (e.g., user is out-of-bounds, user has crossed goal line, etc.). Additionally, or alternatively, emission from the illumination sources 22, 26 of the device 12 and piece of sports equipment 14 may also be modified to indicate the player's movement relative to the marker 68. Additionally, or alternatively, the device 12 may emit a sound and/or haptic effect so as to provide indication that a player has crossed over a boundary on the playing surface (e.g., user is out-of-bounds, user has crossed goal line, etc.).

Figure 10A:
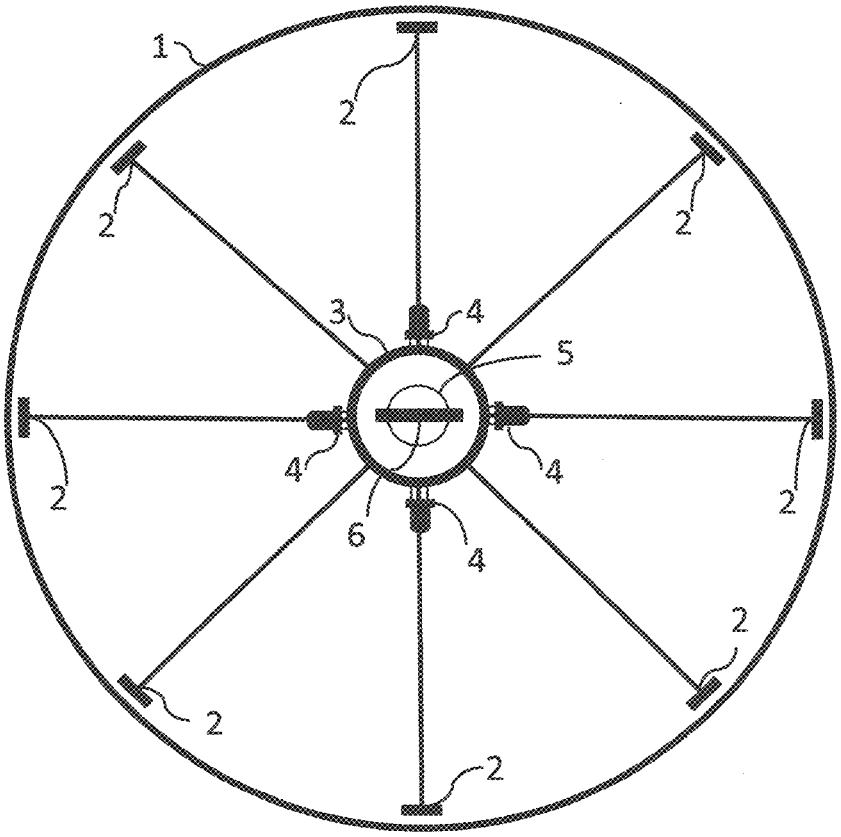
FIGS. 10A and 10B are bottom and side cross-sectional views of another embodiment of a movable piece of sports equipment consistent with the present disclosure.
Figure 10B:
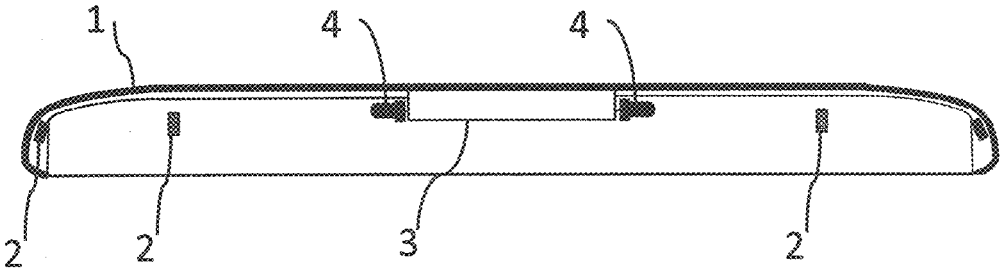

FIGS. 10A and 10B are bottom and side cross-sectional views of another embodiment of a movable piece of sports equipment 1 consistent with the present disclosure. As shown, the movable piece of sports equipment 1 is a flying disc 1. The flying disc 1 may be constructed of a translucent, light colored plastic that allows for the transmission of light through the body. The disc 1 may include an enclosed hollow chamber 3 along an underside portion. The chamber 3 may include a battery holder sub-chamber 5, battery hold down strap 6, and one or more light emitting diodes (LEDs) 4 capable of producing at least two different colors depending on a polarity of the current passed through them and the electronic circuit to which they are connected. The disc 1 may further include one or more sensors 2. As described in greater detail herein, one or more sensors 2 may be configured to sense when a user possesses the disc 1 and further modify an emission of the LEDs 4 based on the user possessing the disc 1.

For example, the one or more sensors may be Hall Effect sensors 2, which are transducers that vary their output voltage in response to changes in a magnetic field. As shown, multiple Hall Effect sensors 2 are located on the perimeter of the disc 1. The sensors 2 may be connected via wires to the center chamber 3, and coupled to central circuitry housed within the center chamber 3.

The LEDs 4 may be powered by the onboard battery and controlled by the sensors 2. The voltage provided to the LEDs 4 may be modulated by a circuit that alternates the output to each color LED to correspond with a respective magnetic field (e.g., north or south) that the Hall Effect sensor 2 detects. The circuit may also contains an electronic latch (a type of bi-stable multivibrator) that has a state, such that its output depends not only on the current input but also on the previous input.

Figure 11:
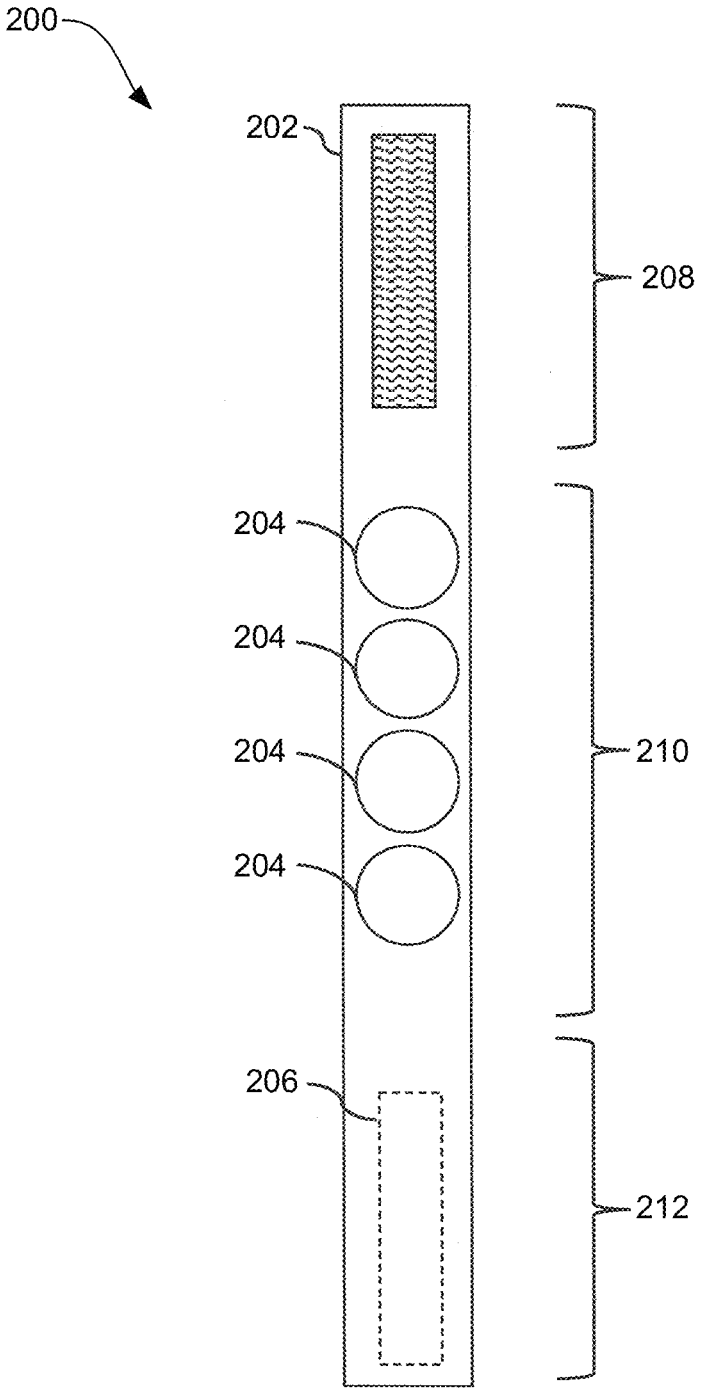
FIG. 11 is a top view of a portion of a wearable device for interaction with the movable piece of sports equipment consistent with the present disclosure.

FIG. 11 is a top view of a portion of a wearable device 200 for interaction with the movable piece of sports equipment 1 of FIGS. 10A and 10B consistent with the present disclosure. As shown, the wearable device 200 may include a strap to be worn on a user's wrist, for example. The strap 200 may be made of a flexible material such as lightweight plastic or fabric. The dimensions of the strap may be approximately 1 inch wide by 10 inches long. The strap 200 may include three sections or regions, a first end 208, a middle section 210, and a second end 212. The first and second ends 208, 212 may be configured to couple to one another by way of any known coupling or fastening means. For example, in one embodiment, the first and second ends 208, 212 may be coupled to one another via a hook and loop manner. For example, a hook side of the fastener is attached to the upper surface 202 fastener is attached to the upper surface 202 of the strap 200 while the loop side is attached to the lower surface 206 of the strap 200 in such a manner to enable the strap to form a loop. The middle section 210 may include one or more magnets 204 oriented in such a way when the user loops the strap around his or her palm, the magnets 204 produce a Northern facing field directed away from the user's hand. The strap 200 may further be configured such that the magnets 204 are oriented in such as way when the user loops the strap around his or her play, so as to produce a Southern facing field directed away from the user's hand.

During a team-based competitive event or activity, such as Ultimate, players on one team will wear a strap 200 having a Northern facing field directed away from their hands and opposing players will wear a strap 200 having a Southern facing field directed away from their hands. Accordingly, teams are based on those who are to wear the Northern facing magnetic straps and by those who are wearing the Southern facing magnetic straps. For simplicity sake, one team will henceforth be referred to as the "Northern" team and the other the "Southern" team, which corresponds to the respective magnetic fields that their straps produce in the outward direction.

Following the rules of ultimate, the game is played in an open field similar to a football or soccer field. The object of the game is to score points by passing the disc to a player in the opposing end zone. Players may not run with the disc, and may only move one foot while holding the disc. Using the system described above, the Northern team lines up and one end of the field and the Southern team lines up at the opposite end. Traditionally, ultimate is played during the day under fully lighted conditions. The system described above allows the game to continue into the night due to the lighted nature of the flying disc.

To begin the game, the Northern/Blue team is on defense and starts by throwing the disc toward the Southern/Red team (similar to a kickoff in American Football). When the disc 1 leaves the hand of the Northern/Blue team member, it remains lighted blue because the last person to touch the disc was on the Northern/Blue team. The "kickoff" throw is received by the Southern/Red team who are on the offense. As soon as the disc is caught by member of the Southern/Red team, the Hall Effect sensor 2 of the disc 1 is tripped and the circuitry is configured to change the disc color from blue to red (or any other predetermined color), thereby indicating that the Southern/Red team is in possession of the disc 1 and attempting to score. For the Southern/Red team to score they must advance down the field toward the end zone by passing the disc to their teammates. During passing between the same members of the Southern/Red team, the disc remains 1 light in a red color, as it has not come into contact with a Northern/Blue team member. If a Northern/Blue team member intercepts a throw made by a Southern/Red team member, the Hall Effect sensor 2 is configured to sense the magnetic field orientation of the Northern/Blue team member and, in turn, the circuitry is configured to modify the color of the disc 1 from red back to blue, thereby indicating possession has changed.

In some embodiments, possession may also be switched if a team misses a catch and the disc hits the ground. For example, if the Northern/Blue team has possession and attempts a pass to another Northern/Blue team member, but fails and the disc 1 hits the ground, the Southern/Red team now has possession and the disc will change from blue to red as soon as the Southern/Red team picks up the disc to take possession. This type of play continues until one team successfully catches a pass in the end zone and scores a point. After a point is scored, each team returns to their respective end zone for another "kickoff" and the game resumes.

Additionally, operations for the embodiments have been further described with reference to the above figures and accompanying examples. Some of the figures may include a logic flow. Although such figures presented herein may include a particular logic flow, it can be appreciated that the logic flow merely provides an example of how the general functionality described herein can be implemented. Further, the given logic flow does not necessarily have to be executed in the order presented unless otherwise indicated. In addition, the given logic flow may be implemented by a hardware element, a software element executed by a processor, or any combination thereof. The embodiments are not limited to this context.

As used in any embodiment herein, the term "module" may refer to software, firmware and/or circuitry configured to perform any of the aforementioned operations. Software may be embodied as a software package, code, instructions, instruction sets and/or data recorded on non-transitory computer readable storage medium. Firmware may be embodied as code, instructions or instruction sets and/or data that are hard-coded (e.g., nonvolatile) in memory devices. "Circuitry", as used in any embodiment herein, may comprise, for example, singly or in any combination, hardwired circuitry, programmable circuitry such as computer processors comprising one or more individual instruction processing cores, state machine circuitry, and/or firmware that stores instructions executed by programmable circuitry. The modules may, collectively or individually, be embodied as circuitry that forms part of a larger system, for example, an integrated circuit (IC), system on-chip (SoC), desktop computers, laptop computers, tablet computers, servers, smart phones, etc.

Any of the operations described herein may be implemented in a system that includes one or more storage mediums having stored thereon, individually or in combination, instructions that when executed by one or more processors perform the methods. Here, the processor may include, for example, a server CPU, a mobile device CPU, and/or other programmable circuitry.

Also, it is intended that operations described herein may be distributed across a plurality of physical devices, such as processing structures at more than one different physical location. The storage medium may include any type of tangible medium, for example, any type of disk including hard disks, floppy disks, optical disks, compact disk read-only memories (CD-ROMs), compact disk rewritables (CD-RWs), and magneto-optical disks, semiconductor devices such as read-only memories (ROMs), random access memories (RAMs) such as dynamic and static RAMs, erasable programmable read-only memories (EPROMs), electrically erasable programmable read-only memories (EEPROMs), flash memories, Solid State Disks (SSDs), magnetic or optical cards, or any type of media suitable for storing electronic instructions. Other embodiments may be implemented as software modules executed by a programmable control device. The storage medium may be non-transitory.

As described herein, various embodiments may be implemented using hardware elements, software elements, or any combination thereof. Examples of hardware elements may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

What is claimed is:

1. A sports gaming system, the system comprising:

a device configured to be worn by a user, the device comprising a shirt or vest configured to be worn over a user's torso, the device comprises a first illumination source and a first control circuitry comprising at least illumination driver circuitry configured to control output to the first illumination source to control operation of the first illumination source and modify emission characteristics of emitted light from the first illumination source, the device comprises at least one adjustable strap element configured to releasably retain the device to the user, and wherein the at least one adjustable strap element comprises at least one coupling operatively coupled to the first control circuitry and configured to releasably retain and communicate with a flag element; and a movable piece of sports equipment comprising a ball or a disc comprising a second illumination source and second control circuitry configured to communicate and exchange data with the device;

wherein at least one of the first and second control circuitries is configured to sense when the user possesses the movable piece of sports equipment and modify an emission of at least one of the first and second illumination sources based on the user possessing the movable piece of sports equipment.

2. The system of claim 1, wherein the flag element comprises a third illumination source and third control circuitry configured to at least transmit or receive data associated with the flag element.

3. The system of claim 2, wherein at least one of the first and third control circuitries is configured to sense when the flag element is disconnected from the coupling on the strap and configured to modify one or more emission characteristics of at least one of the first and third illumination sources based on the disconnection, the emission characteristics selected from the group consisting of: illumination intensity, illumination pattern, and illumination spectrum.

4. The system of claim 2, wherein at least one of the device and the flag element further comprises at least one of an audio output source configured to emit an audible sound and a haptic feedback source configured to emit a haptic effect.

5. The system of claim 4, wherein at least one of the first and third control circuitries is configured to sense when the flag element is disconnected from the coupling on the strap and configured to modify an emission of at least one of the audio output and haptic feedback sources based on the disconnection.

6. The system of claim 1, wherein the device further comprises at least one fiber optic cable optically coupled to the first illumination source and configured to transmit emitted light along a length thereof.

7. The system of claim 6, wherein the at least one fiber optic cable is a side-firing cable.

8. The system of claim 1, wherein the first and second control circuitries are each able to wirelessly transmit data with one another.

9. The system of claim 1, wherein at least one of the first and second control circuitries is configured to modify one or more emission characteristics of at least one of the first and second illumination sources based on the sensed user possession of the movable piece of sports equipment, the emission characteristics selected from the group consisting of: illumination intensity, illumination pattern, and illumination spectrum.

10. The system of claim 1, wherein at least one of the device or the movable piece of sports equipment further comprises at least one of an audio output source configured to emit an audible sound or a haptic feedback source configured to emit a haptic effect based on the user possessing the movable piece of sports equipment.

11. The system of claim 1, further comprising on-field equipment comprising a plurality of markers for defining one or more boundaries of a playing surface, at least one of the plurality of markers comprises a fourth illumination source and fourth control circuitry configured to at least transmit or receive data associated with the at least one marker.

12. The system of claim 1, wherein at least one of the first and second control circuitries is configured to communicate with a remote device.

* * * * *